US005489257A

United States Patent [19]

Li

[11] Patent Number: 5,489,257

[45] Date of Patent: Feb. 6, 1996

[54] MASSAGING ASSEMBLY WITH MOVABLE LOWER-BACK SUPPORTING MEMBER

[76] Inventor: Wen-Pin Li, No. 164, Cheng-Kung Rd., Feng-Yuan City, Taichung Hsien, Taiwan

[21] Appl. No.: 367,944

[22] Filed: Jan. 3, 1995

[51] Int. Cl.[6] ..... A61H 1/02

[52] U.S. Cl. ..... 601/98; 601/84; 601/26

[58] Field of Search ..... 601/5, 23, 24, 601/26, 29, 31, 33, 34, 84, 90–92, 97, 98; 248/913, 118; 482/68, 142, 70, 79, 80

[56] References Cited

U.S. PATENT DOCUMENTS

| | | | |
|---|---|---|---|
| 1,982,843 | 12/1934 | Traver | 601/23 X |
| 2,642,288 | 6/1953 | Bell | 601/24 X |
| 2,826,192 | 3/1958 | Mangas | 601/29 X |
| 2,924,456 | 2/1960 | Miller | 482/142 X |
| 3,043,293 | 7/1962 | Rider | 601/98 X |
| 4,026,279 | 5/1977 | Simjian | 601/5 |
| 4,844,054 | 7/1989 | Raemdonck | 601/34 X |
| 5,107,822 | 4/1992 | Ohashi | 601/23 |
| 5,169,363 | 12/1992 | Campanaro et al. | 482/142 X |
| 5,224,909 | 7/1993 | Hamilton | 601/33 X |
| 5,328,443 | 7/1994 | Lee | 601/98 X |

*Primary Examiner*—Robert A. Hafer
*Assistant Examiner*—Brian E. Hanlon
*Attorney, Agent, or Firm*—Curtis, Morris and Safford

[57] ABSTRACT

A massaging assembly includes a massaging apparatus and a movable lower-back supporting member. The massaging apparatus includes a hollow casing with a top wall and a front wall, a rest member disposed on top of the top wall, and a driving unit mounted in the casing. The driving unit extends through the top wall of the casing so as to connect with and drive reciprocatingly the rest member from side to side. The lower-back supporting member is to be disposed spacedly from the front wall of the casing and parallel to direction of reciprocating movement of the rest member. The supporting member includes a base and a slide plate mounted slidably on top of the base. The slide plate is slidable in a direction parallel to the direction of reciprocating movement of the rest member.

6 Claims, 4 Drawing Sheets

MASSAGING ASSEMBLY WITH MOVABLE LOWER-BACK SUPPORTING MEMBER

BACKGROUND OF THE INVENTION

1. Field of the Invention

The invention relates to a massaging assembly, more particularly to a massaging assembly which is capable of providing an improved muscle stretching effect.

2. Description of the Related Art

A conventional massaging apparatus, which gives twisting and swinging motions to the lower body portion of a user lying on his back, comprises a casing, an ankle rest disposed on top of a top wall of the casing for supporting the ankles of the user thereon, and a driving unit mounted in the casing. The driving unit extends through the top wall of the casing so as to connect with and drive reciprocatingly the ankle rest from side to side. Thus, when the massaging apparatus is in use, the ankles of the user reciprocate from side to side, and the legs reciprocate about the waist to massage the leg muscles.

It is noted that the muscle stretching effect of the conventional massaging apparatus is relatively poor since the massaging apparatus only causes reciprocating movement of the ankles and the legs.

SUMMARY OF THE INVENTION

Therefore, the object of the present invention is to provide a massaging assembly with a massaging apparatus which gives twisting and swinging motions to a body part of a user lying on his back, and a movable lower-back supporting member which supports the lower-back portion of the user so as to achieve an improved muscle stretching effect.

Accordingly, the massaging assembly of the present invention comprises a massaging apparatus and a movable lower-back supporting member. The massaging apparatus includes a hollow casing with a top wall and a front wall, a rest member disposed on top of the top wall, and a driving unit mounted in the casing. The driving unit extends through the top wall of the casing so as to connect with and drive reciprocatingly the rest member from side to side. The lower-back supporting member is to be disposed spacedly from the front wall of the casing and parallel to direction of reciprocating movement of the rest member. The supporting member includes a base and a slide plate mounted slidably on top of the base. The slide plate is slidable in a direction parallel to the direction of reciprocating movement of the rest member. When the massaging assembly is in use, the lower-back portion of a user lying on his back is supported on the supporting member while the head or the ankles of the user are supported on the rest member. Reciprocating movement of the rest member and inertial forces that are generated on the user's center of gravity result in stretching of muscles of the user.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
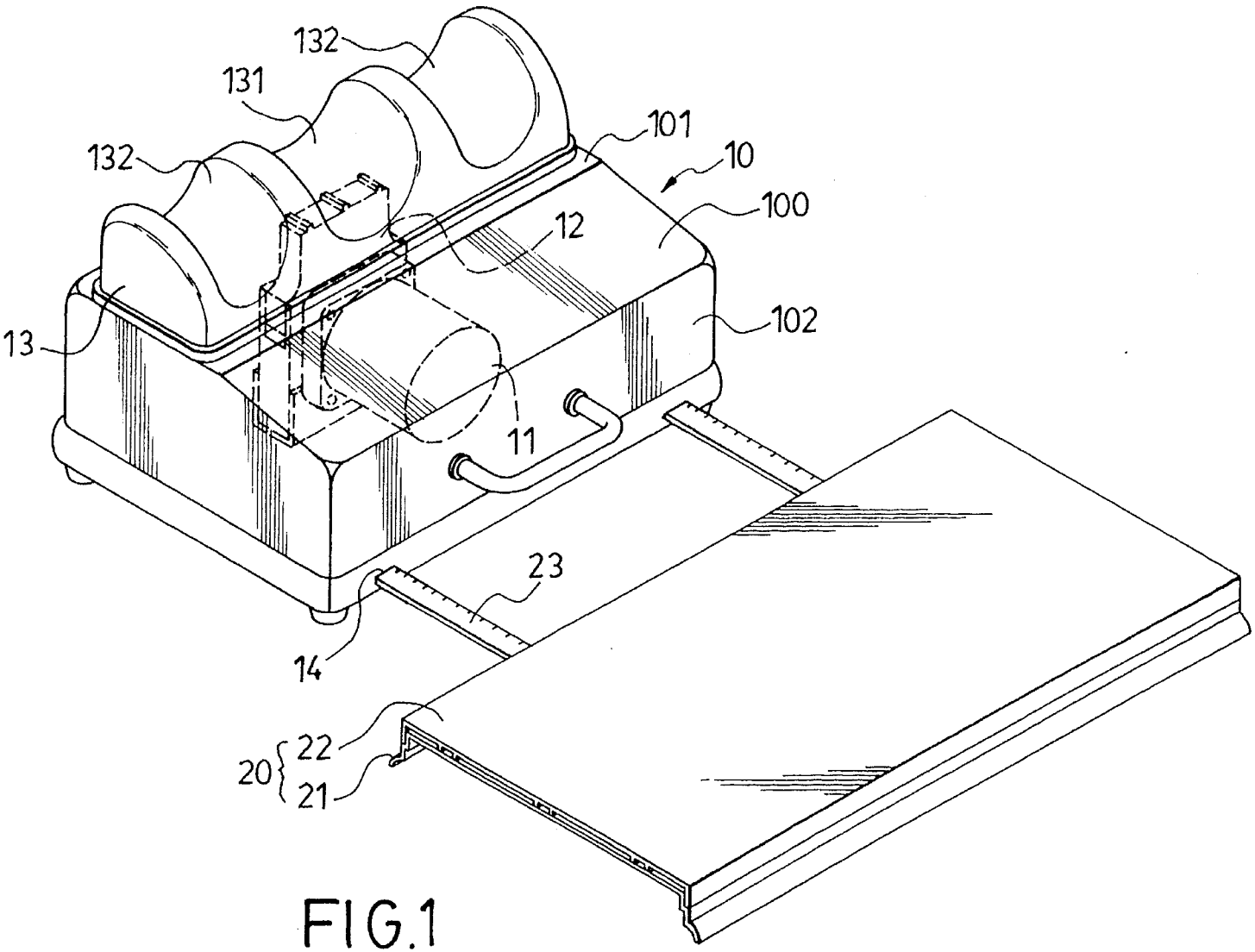
FIG. 1 is a perspective view of the preferred embodiment of a massaging assembly according to the present invention.

Referring to FIG. 1, the preferred embodiment of a massaging assembly according to the present invention is shown to comprise a massaging apparatus 10 and a movable lower-back supporting member 20.

The massaging apparatus 10 includes a hollow casing 100 having a top wall 101 and a front wall 102 formed with a pair of mounting holes 14, a rest member 13 disposed on top of the top wall 101 of the casing 100 and formed with a first concave portion 131 that is capable of receiving the head of the user and a pair of second concave portions 132 that are on two sides of the first concave portion 131 and that are capable of receiving the ankles of the user, and a driving unit mounted in the casing 100. The driving unit includes a motor 11 and an eccentric drive mechanism 12 which is connected to an output shaft of the motor 11 and which extends through the top wall 101 of the casing 100 so as to connect with and drive reciprocatingly the rest member 13 from side to side.

Figure 2:
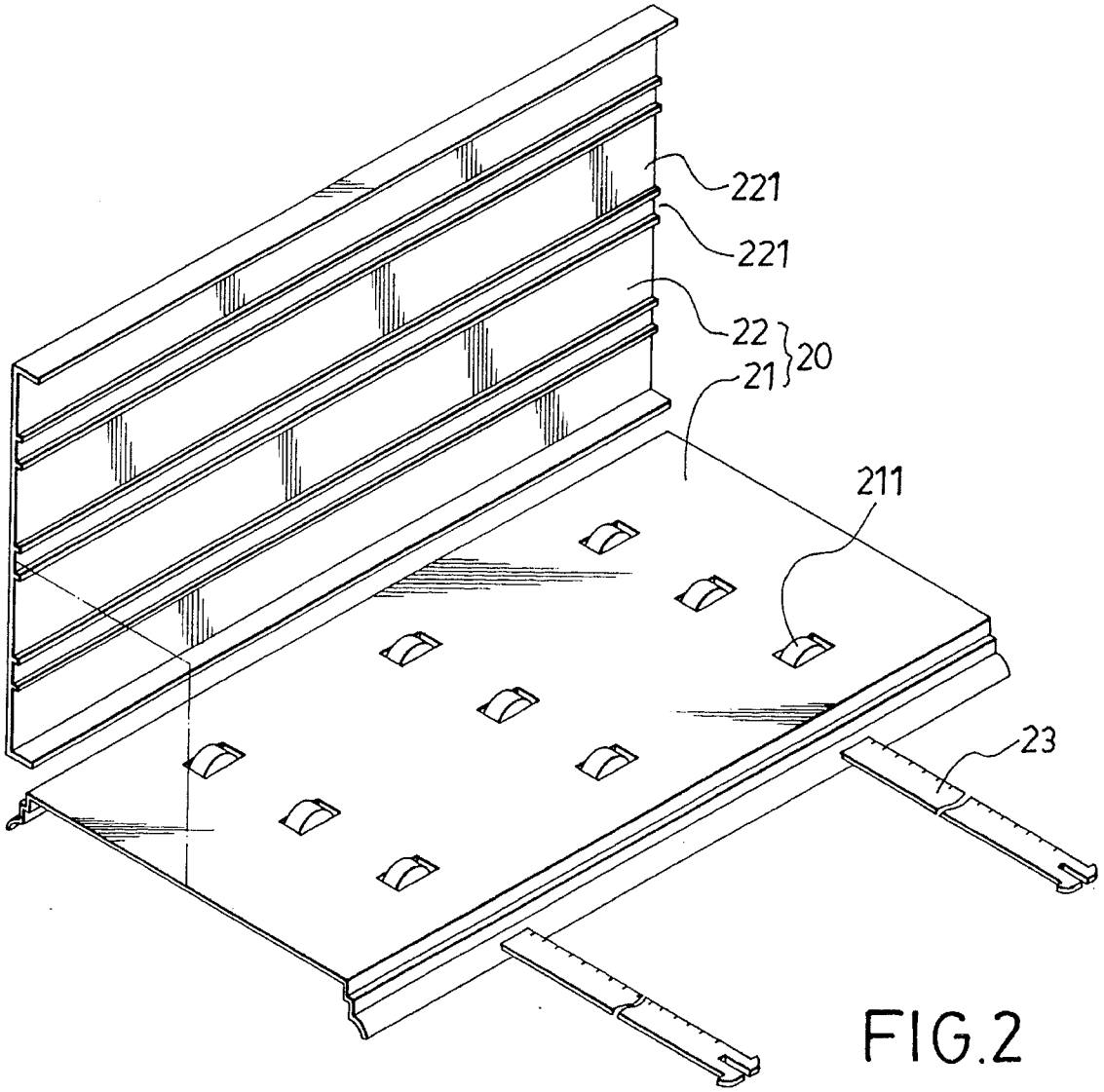
FIG. 2 is a partly exploded view of a movable lower-back supporting member of the preferred embodiment.

The lower-back supporting member 20 is to be disposed spacedly from the front wall 102 of the casing 100 and parallel to direction of reciprocating movement of the rest member 13. Referring to FIG. 2, the supporting member 20 includes a base 21 and a slide plate 22 mounted slidably on top of the base 21. The base 21 has a plurality of rollers 211 mounted rotatably thereon and protruding through a top surface of the base 21 so as to support slidably the slide plate 22 on the base 21 in a direction parallel to the direction of reciprocating movement of the rest member 13. The slide plate 22 has a bottom surface formed with a plurality of parallel elongated rail grooves 221. The rollers 211 are arranged in,parallel rows and extend into a corresponding one of the rail grooves 221. The base 21 further has a pair of connecting bars 23 which extend retractably into the casing 100 of the massaging apparatus 10 through the mounting holes 14 in the front wall 102 of the latter and which are marked off in units of length to facilitate use of the massaging assembly by persons of different body sizes.

Figure 3:
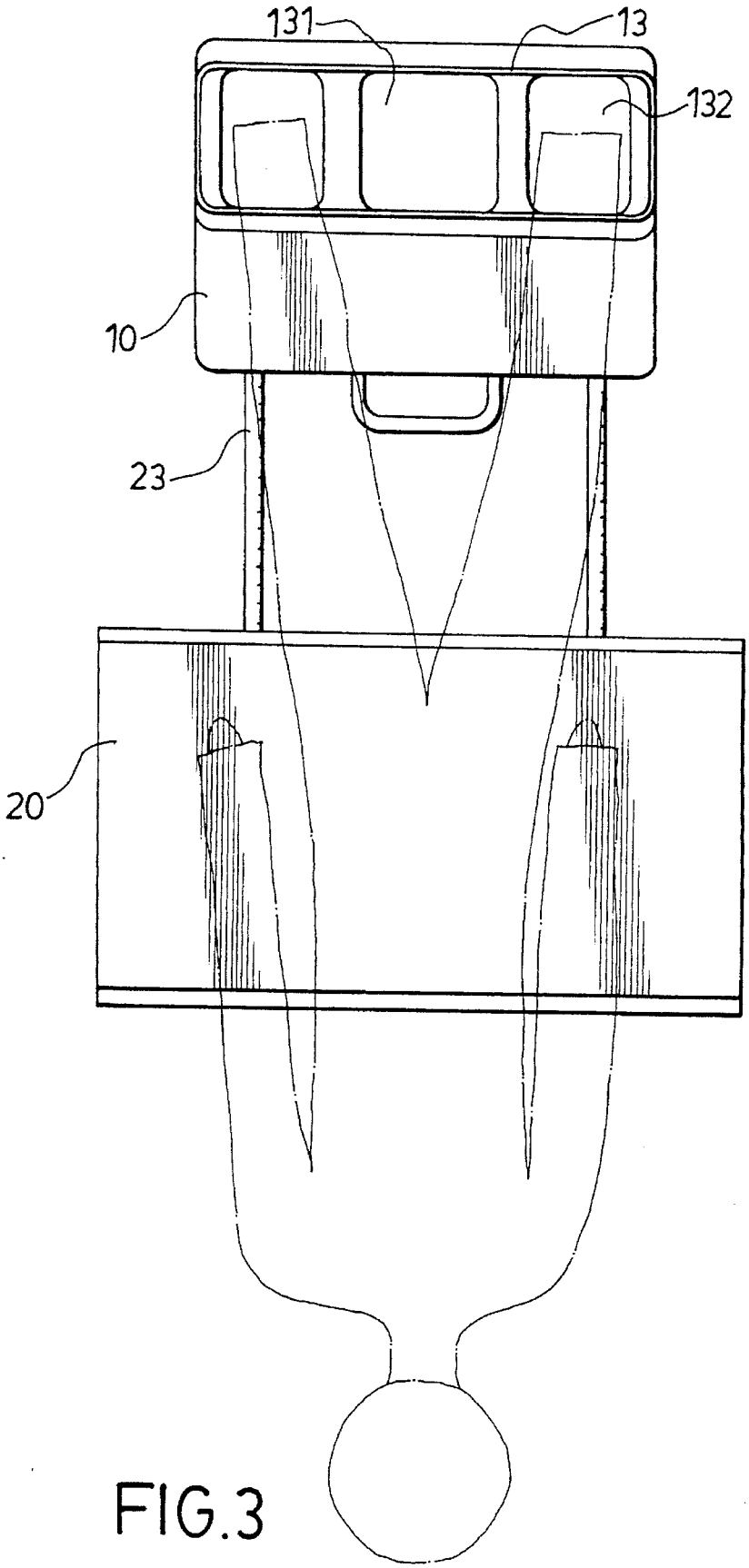
FIGS. 3 and 4 illustrate the preferred embodiment when in use.

FIG. 3 illustrates a preferred use of the massaging assembly of this invention. In use, the user lies on his back such that his lower-back portion is on the support member 20 and his ankles are on the second concave portions 132 of the rest member 13. Since the gravity center of the user when lying on his back is near his buttocks, the weight of the user is concentrated on the support member 20. When the motor 11 of the massaging apparatus 10 is activated, the drive mechanism 12 drives reciprocatingly the rest member 13 from side to side, thereby reciprocating the ankles of the user from side to side. Due to the design of the lower-back supporting member 20, when the rest member 13 moves to the left, an inertial force causes the user's center of gravity to move to the left. However, when the rest member 13 moves abruptly to the right, the user's center of gravity is still moving to the left at that instant. Thus, stretching forces are generated to stretch the muscles of the user. The user's center of gravity then moves to the right by virtue of the inertial force that results due to movement of the rest member 13 to the right. When the rest member 13 moves abruptly to the left, the user's center of gravity is still moving to the right at that instant, thereby generating stretching forces to stretch the muscles of the user. This illustrates how the massaging assembly of the present invention can provide an improved muscle stretching effect.

Figure 4:
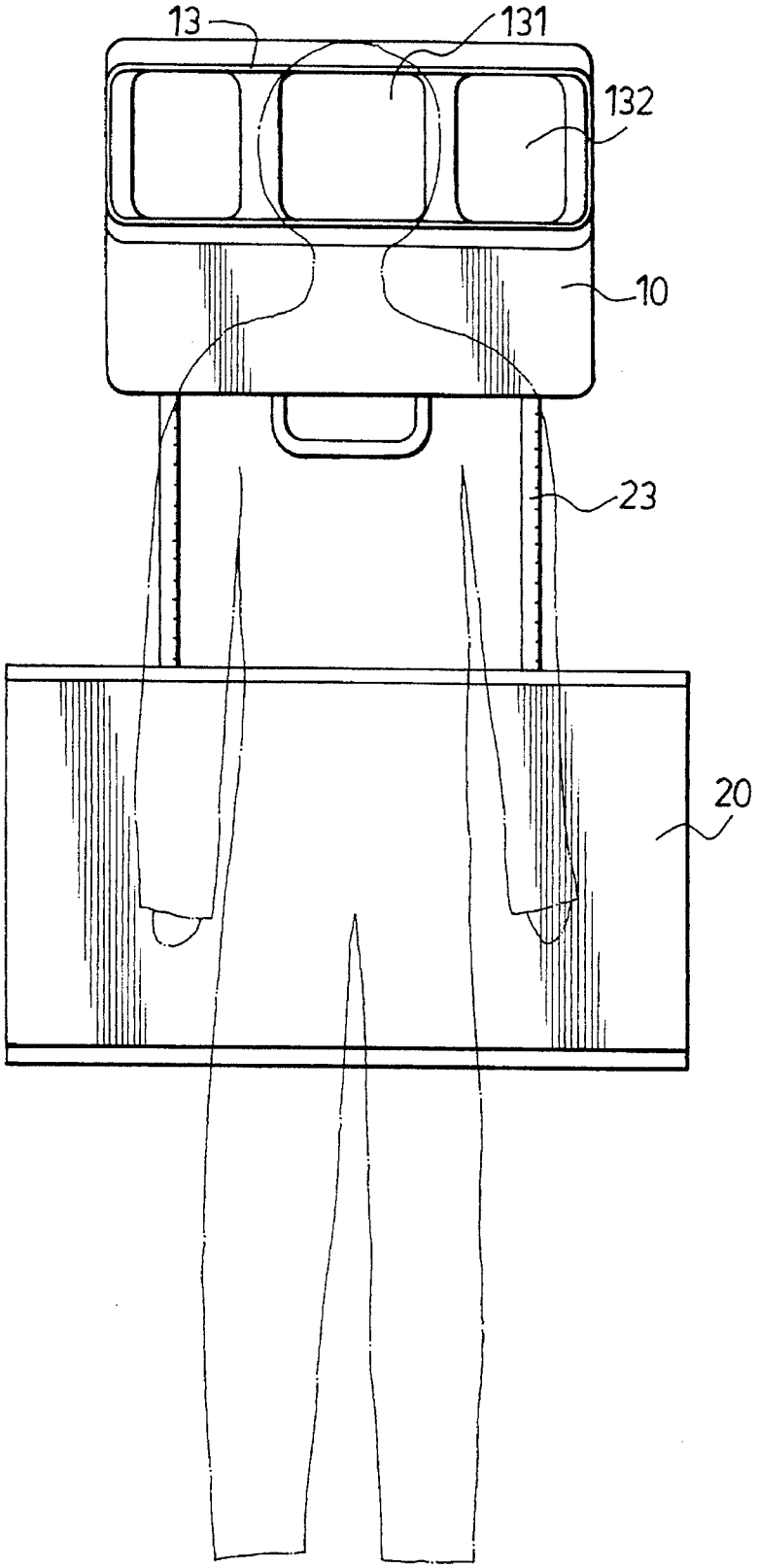

FIG. 4 illustrates another preferred use of the massaging assembly of this invention. When the user wishes to stretch muscles at his upper back portion, the user lies on his back such that his lower-back portion is on the support member 20 and his head is on the first concave portion 131 of the rest member 13. The operation and effects provided by the massaging assembly are similar to those described in the preceding paragraph and will not be detailed further.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A massaging assembly, comprising:

a massaging apparatus including a hollow casing with a top wall and a front wall, a rest member, and a driving unit mounted in said casing, said rest member being disposed on top of said driving unit and above said top wall of said casing, said casing having a first side and a second side opposite to said first side, said driving unit extending through said top wall of said casing so as to connect with and drive reciprocatingly said rest member from said first side to said second side; and a movable lower-back supporting member to be disposed spacedly from said front wall of said casing, said supporting member having a longitudinal axis parallel to the direction of reciprocating movement of said rest member, said supporting member including a base and a slide plate mounted slidably on top of said base, said slide plate being slidable in a direction parallel to the direction of reciprocating movement of said rest member;

whereby, when said massaging assembly is in use, the lower-back portion of a user lying on his back is supported on the supporting member while the head or the ankles of the user are supported on the rest member, and muscles of the user are stretched due to reciprocating movement of the rest member and due to inertial forces that are generated on the user's center of gravity.

2. The massaging assembly as claimed in claim 1, wherein said front wall of said casing of said massaging apparatus is formed with a mounting hole, said base of said supporting member further having a connecting bar which extends retractably into said casing through said mounting hole, said connecting bar being marked off in units of length.

3. The massaging assembly as claimed in claim 1, wherein said rest member is formed with a first concave portion that is capable of receiving the head of the user and a pair of second concave portions that are capable of receiving the ankles of the user.

4. The massaging assembly as claimed in claim 3, wherein each one of said pair of second concave portions is disposed on a side of said first concave portion.

5. The massaging assembly as claimed in claim 1, wherein said base has a plurality of rollers mounted therein, said rollers protruding through a top surface of said base and slidably supporting said slide plate on said base.

6. The massaging assembly as claimed in claim 5, wherein said slide plate has a bottom surface formed with a plurality of parallel elongated rail grooves, said rollers being arranged in parallel rows and each of said parallel row of rollers extending into a corresponding one of said rail grooves.

* * * * *